US006094170A

United States Patent [19]

Peng

[11] Patent Number: 6,094,170

[45] Date of Patent: Jul. 25, 2000

[54] MEANDER LINE PHASED ARRAY ANTENNA ELEMENT

[75] Inventor: Sheng-Yeng Peng, Escondido, Calif.

[73] Assignee: Advanced Application Technology, Inc., Taipei Hsien, Taiwan

[21] Appl. No.: 09/325,120

[22] Filed: Jun. 3, 1999

[51] Int. Cl.[7] ..... H01Q 1/38

[52] U.S. Cl. ..... 343/700 MS; 343/846; 343/872

[58] Field of Search ..... 343/700 MS, 829, 343/846, 872, 873, 702

[56] References Cited

U.S. PATENT DOCUMENTS

| | | | |
|---|---|---|---|
| 4,260,988 | 4/1981 | Yanagisawa et al. | 343/700 MS |
| 4,475,107 | 10/1984 | Makimoto et al. | 343/700 MS |
| 5,786,793 | 7/1998 | Maeda et al. | 343/700 MS |
| 5,793,330 | 8/1998 | Gans et al. | 343/700 MS |
| 5,914,693 | 6/1999 | Takei et al. | 343/767 |

*Primary Examiner*—Don Wong
*Assistant Examiner*—Tho Phan
*Attorney, Agent, or Firm*—Thomas, Kayden, Horstemeyer & Risley LLP

[57] ABSTRACT

A meander line phased array antenna element is disclosed. The phased array antenna element has a dielectric plate, a transceiver medium component formed on the dielectric plate by a printed-circuit method and a microstrip line having a strip line for electrical connection with the transceiver medium component and a ground formed on the back of the dielectric plate. Since the phased array antenna element is planar, it can be mounted on any surface, such that the quality of the transmitted and/or received signal is able to be enhanced without any influence on the size of the product using this technique.

4 Claims, 2 Drawing Sheets

MEANDER LINE PHASED ARRAY ANTENNA ELEMENT

BACKGROUND OF THE INVENTION

1. Field of the Invention

The present invention relates to a phased array antenna element, and more particularly to a phased array antenna element using a printed-circuit method to form a transceiver medium component and a microstrip line for electrical connection with the transceiver medium component on a side of a dielectric plate. The transceiver medium component is a meander line shape, such that not only is the size of the applied object compact, but it is also convenient to use.

2. Description of Related Art

Radio transmission is a very powerful and useful method to communicate with other subjects. Through the use of radio transmissions, people can talk with distant friends or even explore the unknown in the universe. Notwithstanding in what fields radio transmission is applied, a giant, protruding antenna is one thing that is inevitable for transmitting and receiving signals with high quality. For a stationary facility, a giant antenna is not a bad thing when taking the quality of signals into consideration. However, a big antenna mounted on a cellular phone is inconvenient.

It has long been a problem for people to miniaturize antennas while retaining the high quality of received and/or transmitted signals.

It is therefore a main object of the invention to provide a phased array transceiver antenna element with a meander line shape that can be printed on any flat surface to mitigate and/or obviate the aforementioned problems.

The major application of this printed-circuit meander line antennas are for wireless and satellite communications. Currently, the frequency of interest is 800/900 MHz and 1700/1800 MHz for cellular phone applications and 1.2 GHz and 2.4 GHz for wireless communications, to replace the traditional mono-pole or dipole wire antennas. In the 21st century, the printed-circuit meander line antenna will extend its applications to other frequency bands to meet the low profile, low cost and high performance challenge requirement.

SUMMARY OF THE INVENTION

The main object of the present invention is to provide a phased array antenna element that uses a printed-circuit method to form a transceiver medium component and a microstrip line for electrical connection with the transceiver medium on a flat side of a dielectric plate. The microstrip line further has a ground line on the back of the dielectric plate. Using the printed-circuit method with copper on the dielectric plate allows the phased array element to be miniaturized. Furthermore, the individual components or legs of the phased array element can be replicated, such that even with the limitation of the size of the element, the quality of the transmitted signals and the received signals is satisfied.

The phased array element constructed in accordance with the present invention has a dielectric plate, a transceiver medium component securely formed on one side of the dielectric plate by a printed-circuit method and a microstrip line also formed by the printed-circuit method on the dielectric plate for electrical connection with the transceiver medium component. With such an arrangement, the phased array antenna element is planar. Therefore, the phased array element is easy to be formed as an integral part of any object with a flat surface, such as cellular phones, airplanes, or even cars.

The detailed features of the present invention will be apparent after reading the following detailed description with appropriate reference to the accompanying drawings.

DETAILED DESCRIPTION OF PREFERRED EMBODIMENT

Figure 1:
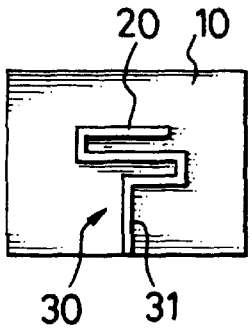
FIG. 1 is a front view of a preferred embodiment of the phased array antenna element in accordance with the present invention.
Figure 2:
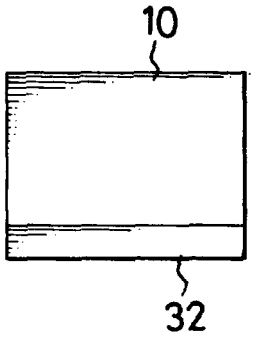
FIG. 2 is a rear view of the embodiment shown in FIG. 1.
Figure 3:
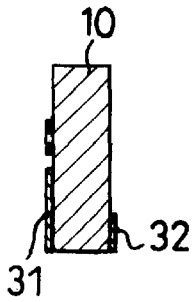
FIG. 3 is a side cross sectional view of the embodiment shown in FIG. 1.

As shown in FIGS. 1 and 2, a phased array antenna element in accordance with the present invention has a dielectric plate (10) made of material with proper thickness and permittivity, such as FR-4, Mylar, ceramic or Kapton. In this embodiment, the dielectric plate (10) is made of FR-4 and is rectangular. The phased array element further has a transceiver medium component (20) securely formed on the dielectric plate (10) by means of a printed-circuit method. The transceiver medium component (20) is a meander line shape, and the dielectric plate (10) further has a microstrip line (30) also formed by the printed-circuit method so as to have electrical connection with the transceiver medium component (20) by strip line (31). Furthermore, the microstrip line (30) has a ground (32) formed on the back of the dielectric plate (10), such that the strip line (31) together with the ground (32) form the microstrip line (30) on the dielectric plate (10) for transmitting and receiving signals.

A housing 35 (shown in dashed overline) is provided to enclose all the above mentioned elements for different commercial purposes.

It is noted that since the phased array element is planar, the inconvenience of a protruding antenna of the conventional product is overcome.

Figure 4:
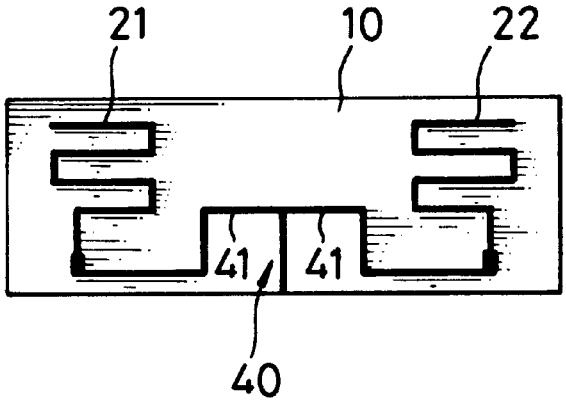
FIG. 4 is a front view of another preferred embodiment of the phased array antenna element in accordance with the present invention.
Figure 5:
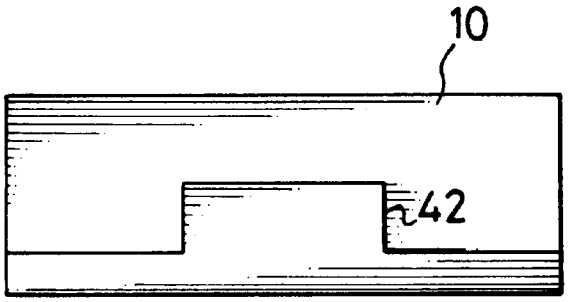
FIG. 5 is a rear view of the embodiment shown in FIG. 4.
Figure 6:
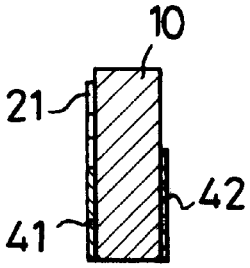
FIG. 6 is a side cross sectional view of the embodiment shown in FIG. 4.

To upgrade the quality of the transmitted and received signals, multiple transceiver medium components or legs (20) can be aligned in parallel to boost the signal quality. Referring to FIGS. 4 and 5, two meander line shaped transceiver medium components (21, 22) are formed on a single dielectric plate (10). A microstrip line (40) for electrical connection with the two sets of the transceiver medium components (21, 22) is formed by a printed-circuit method on the dielectric plate (10) when the two transceiver medium components (21, 22) are formed. The microstrip line (40) has a strip line (41) substantially and electrically connected with both of the transceiver medium components (21, 22) and a ground (42) formed on the back of the dielectric plate (10). The ground (42) provides ground to both of the transceiver medium components (21, 22).

With such an arrangement, the aligned transceiver medium components (21, 22) can enhance the quality of the transmitted and received signals. Since this kind of antenna is planar, it is applicable to any product surface without any influence on the existing function. Therefore, by such a constructed phased array element, any product using this meander line phased array element will have a "smart skin".

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A phased array antenna element comprising:

a dielectric plate (10);

at least one transceiver medium component (20) formed on the dielectric plate (10) by a printed-circuit method and having a meander line shape; and a microstrip line (30) formed on the dielectric plate (10) by a printed-circuit method and having a strip line (31) for electrical connection with the transceiver medium component (20) and a ground (32) formed on the back of the dielectric plate (10).

2. The phased array antenna element as claimed in claim 1, wherein when the number of the transceiver medium components mounted on the dielectric plate (10) is more than one, they are aligned in parallel.

3. The phased array antenna element as claimed in claim 2 further having a housing for enclosing the phased array.

4. The phased array antenna element as claimed in claim 1 further having a housing for enclosing the phased array antenna element.

* * * * *